United States Patent [19]

Dambre

[11] Patent Number: 4,759,806

[45] Date of Patent: Jul. 26, 1988

[54] PROCESS FOR MANUFACTURING PEARLITIC STEEL WIRE AND PRODUCT MADE THEREBY

[75] Inventor: Paul Dambre, Kemmel, Belgium

[73] Assignee: N.V. Bekaert S.A., Zwevegem, Belgium

[21] Appl. No.: 948,077

[22] Filed: Dec. 31, 1986

[30] Foreign Application Priority Data

Jan. 10, 1986 [GB] United Kingdom ..... 8600533

[51] Int. Cl.[4] ..... C21D 1/26

[52] U.S. Cl. ..... 148/12 B; 148/320; 148/156; 428/676

[58] Field of Search ..... 148/155, 156, 12 B; 72/286; 428/676

[56] References Cited

U.S. PATENT DOCUMENTS 3,574,000 4/1971 Geipel et al. ..... 148/12 B
3,584,494 6/1971 Geipel et al. ..... 148/12 B
3,645,805 2/1972 Hoffmann et al. ..... 148/12 B
4,265,678 5/1981 Hachisuka et al. ..... 148/12 B

FOREIGN PATENT DOCUMENTS 1011972 11/1961 United Kingdom .

*Primary Examiner*—Christopher W. Brody
*Attorney, Agent, or Firm*—Foley & Lardner, Schwartz, Jeffery, Schwaab, Mack, Blumenthal & Evans

[57] ABSTRACT

A process for manufacturing pearlitic steel wire, particularly with fine diameters and for use in reinforcing rubber vehicle tires. The wire is subjected to a patenting treatment before being drawn down to its final diameter, but is held at the transformation temperature for no more tha 5 seconds after transformation has taken place. Such a step renders the wire capable of being subjected to true strains of more than 3.0 and achieving tensile strengths of 3000 $Nmm^{-2}$ or more. The wire may be cooled from the transformation temperature via a first stage in which the temperature is reduced to 400° to 450° C. over a period of time not less than 3 seconds.

39 Claims, 4 Drawing Sheets

PROCESS FOR MANUFACTURING PEARLITIC STEEL WIRE AND PRODUCT MADE THEREBY

The present invention relates to a process for producing pearlitic steel wire and more particularly to an improved method for producing high-tensile pearlitic steel wire with a small cross-sectional area which can be used e.g. for reinforcing rubber articles.

Steel wire is conventionally manufactured by preparing a hot rolled rod of an appropriate steel composition and by mechanical cold working the wire rod to a desired lower cross-section by means of wire drawing. To produce fine diameter high-carbon steel wire, for example having a diameter of up to 1.5 mm, intermediate heat treatment (mostly metallurgical patenting) is required to restore ductility in order to permit substantial reductions in cross-sectional area. To obtain a pearlitic steel wire of prescribed minimum tensile strength one normally chooses a suitable combination of a steel composition (carbon content) and a final wire drawing operation of sufficient diameter reduction following the last patenting treatment.

As used herein the term "wire" is to have a broad interpretation, and covers elongate forms which may vary from filamentary to ribbon-like shape with a cross-section which can be e.g. round or flat. A round shape is usually obtained by wire drawing through circular dies and a flat shape is obtained by laminating (flat rolling) a round or flattened cross-section, or alternatively by extrusion or drawing through shaped dies.

The types of steel with which the invention is most concerned, are carbon steel alloys having a carbon content from 0.4 to 1.2% (all composition percentages are percentages by weight, more often from 0.6 to 1.0% C, and further comprising max. 1% Mn, max. 1% Si, max. 0.035% P, max. 0.035% S, the balance apart from iron being unavoidable steelmaking impurities. A particularly favoured composition is 0.7 to 1.0% C, 0.2 to 0.6% Mn, 0.1 to 0.35% Si, max. 0.025% P, max. 0.025% S, max. 0.1% residual scrap elements and the remainder iron and unavoidable impurities.

The most suitable structure for cold working a steel wire so as to achieve an elevated tensile strength is that of fine pearlite obtained by lead patenting or by a similar isothermal transformation process. Such processes consist of heating the steel to a high temperature (900° to 1000° C.) at which carbon dissolution and austenitic formation occur, followed by immersion in a quench-transformation bath (usually molten lead) at a temperature between 500° to 700° C. to decompose the austenite to a pearlitic structure of desired lamellar fineness with cementite plates in a ferrite matrix. Once the desired pearlitic structure has been obtained, the steel wire is subsequently cooled. The patented steel so obtained can be cold worked to a required degree, for example laminated or drawn into wire. More in general "patenting" is the transformation of austenite to perlite in a temperature range between 500° and 700° C.

However, the cross-section of patented carbon steel wire cannot be reduced indefinitely, whatever may be the quality of the initial structure; furthermore, the tensile strength which can be achieved by cold work hardening is limited. There is a working limit which cannot be exceeded without seriously impairing the mechanical properties of the drawn wire or causing an unacceptable increase in the frequency of wire breaks. Thus, beyond such limit the wire receives an overdrawn structure (severe structural damage) resulting in a significant drop in ductility properties and leading to a sharp increase of erratic brittle wire fractures upon drawing. This poses a serious limit in respect to the ultimate capabilities of known steel wire making. The limit may depend on a number of factors including steel composition and purity, wire diameter pearlitic structure, lubrication, processing care and so on.

In the conventional process for drawing fine wire, for example 0.7 to 0.8% carbon steel wire of 0.1 to 0.5 mm diameter intended for tire cord manufacture, the normal drawing limit is found to represent approximately a total reduction in cross-sectional area of about 97% and a useful ultimate tensile strength of about 3000–3200 $N/mm^2$. A drawback in industrial practice is that wire drawability and ductility may show considerable fluctuations when working in the vicinity of this limit.

Prior art attempts aimed at increasing the drawing limit and raising the useful tensile strength largely center around improved steel wire compositions, either by using alloyed carbon steels (e.g. with cobalt additions) to refine and harden the initial pearlite structure or by preparing steels of exceptional purity to enhance ultimate wire plasticity or by a combination thereof.

Such proposals have proven to be adequate in a number of circumstances. However, the use of special alloyed steels or of ultra-refined steel grades involves extra steelmaking effort and may considerably increase raw material cost.

The object of the present invention is to provide an improved process for the manufacture of a pearlitic steel wire which can be drawn to high-tensile strengths.

A steel wire having a round cross-section is called to be a high-tensile steel wire if its final tensile strength R lies above the value $$R_m(Nmm^{-2})=2250-1130 \log d$$

where d is the diameter of the wire and is expressed in mm. Extensive investigations have been carried out on extreme drawability and strain hardening of pearlite wires patented at different temperatures.

There has been found an anomaly in strain hardening behavior and plasticity of certain wires drawn beyond a given level of cold working i.e. with the total cross-sectional area reduction above about 96%, notwithstanding the fact that initial pearlite structure and as patented wire strength were apparently the same. Thorough analysis of these wires has enabled identification of an unexpected beneficial effect which occurs at high strain when wires are treated in a particular way.

Accordingly, viewed from one broad aspect the present invention relates to a process for producing a pearlitic steel wire, said process comprising the steps of subjecting the wire to a patenting operation in which it undergoes transformation in a transformation temperature range and of drawing the patented wire to a smaller diameter, characterised in that during the patenting operation the wire is held in the transformation temperature range during a retention time of no more than five seconds after transformation has been completed and in that the smaller diameter corresponds to a true strain of more than 3. The true strain $\epsilon$ is defined as the natural logarithm of the ratio of initial to final cross-section.

The transformation temperature range lies between 520° and 680° C. Normally the transformation temperature of the patenting operation is substantially constant. But this is not necessary: Patenting is also possible with a continuous or even stepwize temperature profile. Such a temperature profile can e.g. be obtained by using more than one quench-transformation bath.

The transformation has been completed if, when the wire is subsequently quenched, neither martensite nor bainite is formed.

The advantageous effect of the small post-transformation time is a significant gain in deformation and strain hardening capacity in the final drawing stage. Comparison of fine microstructural features of known wires and wires in accordance with the method reveals an aligned cementite/ferrite structure which in the case of the invention shows a more uniform plastic stretching of cementite lamellae at very high strains. In current wires deformed beyond a given limit, cementite strain is more rapidly impeded causing break-up of the lamellae and onset of embrittlement.

It has been observed that wires treated in accordance with the invention possess a greater plasticity reserve and may also attain a marked gain in ultimate strength as compared to conventional wires drawn in the same conditions. This is reflected also in better torsional and bending ductility of the wires compared to conventional wires of the same strength level and in their capacity to sustain additional drawing passes in the stage of extreme hardening (cross section reduction>96–97% and true strain $\epsilon>3.3$–$3.5$) without suffering from overdrawn brittleness and increased drawing breaks which are unavoidable in normal practice. This advantageous behavior is most important for effecting extreme drawing reductions in a more reliable way than hitherto possible and also for the achievement of superhigh tensile strength in excess of the "marginal" range of 3,200–3,500 $N/mm^2$ without using conventional and more expensive steel composition.

It will be appreciated that in general the invention is of the greatest significance in the case of steel wires which will be drawn to a cold working degree exceeding a true strain value of 3, and which will achieve a tensile strength of 3,000 $Nmm^{-2}$, preferably above 3,500 $Nmm^{-2}$.

Further advantageous results may be obtained by cooling the wire from the transformation temperature range in accordance with a particular profile. There may be a relatively slow precooling stage after the retention time to about 400° to 450° C. over a period of not less than 3 seconds, followed by cooling to room temperature in any desired way.

The invention also extends to the wire made in accordance with the process and particularly a wire which is provided with a rubber adherent surface of e.g. brass and is intended for use in reinforcing tires.

The invention and certain preferred embodiments, as well as technical improvements over the prior art, may be better understood by reference to the following detailed description and examples and to the accompanying drawings, in which.

Figure 1:
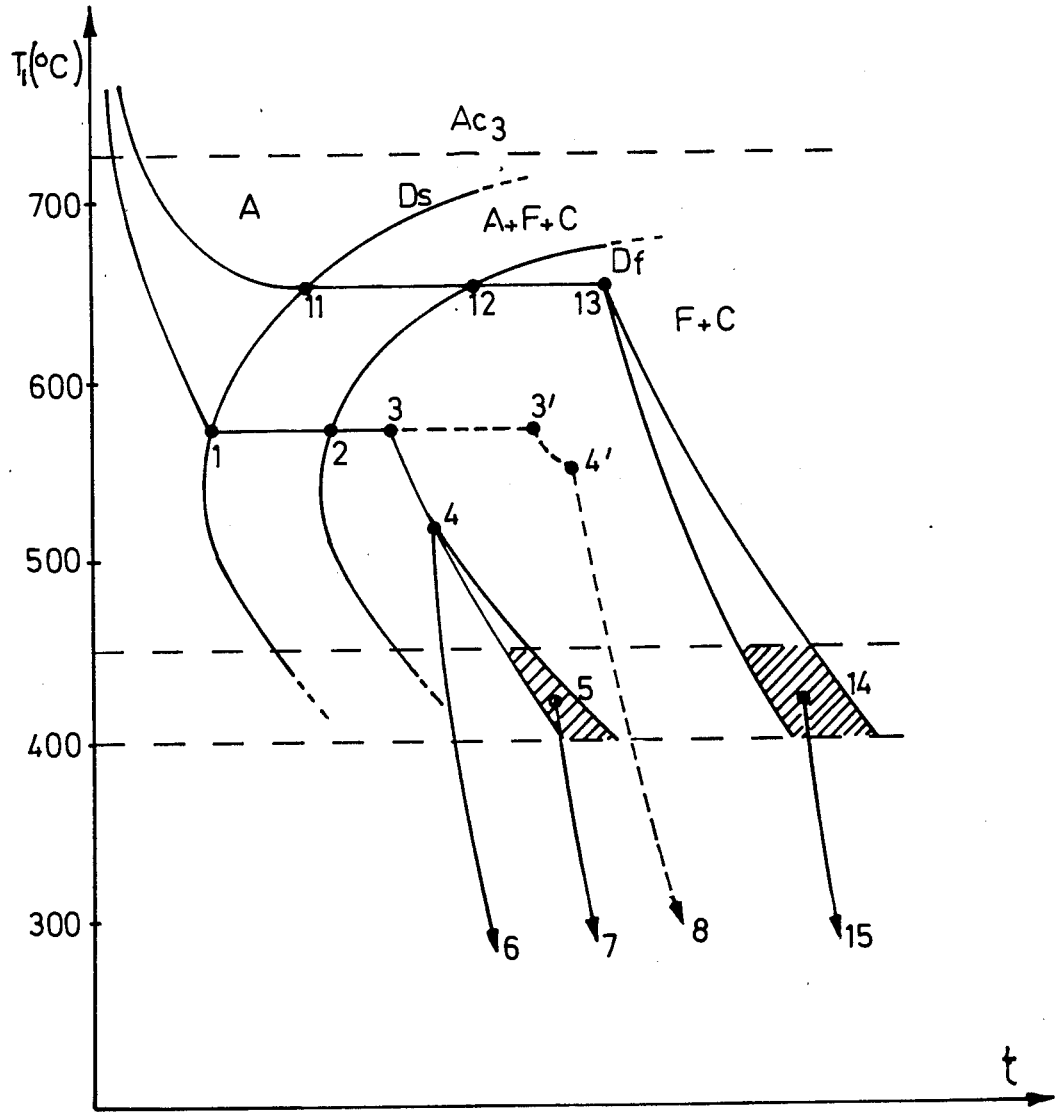
FIG. 1 shows the time-temperature-transformation (T.T.T.) diagram for a eutectoid carbon steel wherein a cooling-transformation curve in accordance with the method of this invention is schematized in comparison with other cooling profiles.

Referring to the drawing of FIG. 1, there are shown two T.T.T.-curves Ds and Df corresponding to the start and finish respectively of austenite (A) decomposition into ferrite (F) and cementite (C). Above a temperature $T_1$ of 500° C. the transformation is largely to pearlite, a lamellar mixture of ferrite and cementite, which progressively becomes coarser with increasing transformation temperature. In accordance with the invention, an austenitized steel wire is rapidly quenched from a high temperature (usually above 900° C.) in the austenitic region A (solid solution of carbon in gamma iron) to a selected pearlite reaction temperature defined by the temperature of the quench medium such as molten lead, molten salt, or a fluidized bed. At this temperature, the steel is allowed to transform during part 1–2 of the related temperature-time profile and is held at that temperature up to point 3, the retention time 2–3 being kept below 5 seconds. After leaving the isothermal transformation bath, the wire is water cooled to room temperature, following temperature profile 3–4–6. As mentioned above the transformation does not need to be an isothermal transformation. Transformation is also possible when the temperature profile 1–2–3 of FIG. 1 is not a horizontal line.

According to a preferred embodiment the wire is allowed to cool along temperature profile 3–5–7, with point 5 corresponding to a temperature in the range of about 400° to 450° C., in such a way that the time interval 3–5 is at least 3 seconds, and preferably not less than 5 seconds. A similar patenting treatment in accordance with the invention at higher pearlite reaction temperature is illustrated by the temperature-time profile 11–1–2–13–15 with a retention time 12–13 of max. 5 seconds and a time interval 13–14 of more than 3 seconds. A prior art wire cooling-transformation profile in current practice is schematized by 1–2–3'–4'–8, showing a rather long arbitrary stay 2–3' at transformation temperature and a rapid quench to room temperature (4'–8) after the wire emerges from the patenting bath.

The time interval during which the wire is dipped in the quench-transformation bath can be diminished in comparison with conventional processes, by increasing the linear speed of the wire, by decreasing the distance over which the wire is dipped in the quench-transformation bath or—for new installations—by decreasing the total length of the quench-tranformation bath. As a consequence, the dimensions of new installations may be smaller than these of existing installations. This leads to considerable cost reduction.

To appreciate the merits of the present invention one has to realize that point 2, indicating transformation completion, frequently corresponds to an isothermal immersion time of a few seconds, say two or three seconds for unalloyed eutectoid carbon steel. In practice the position of point 2 can vary widely depending on wire diameter and quench speed, austenite stability and alloying content of the steel, actual transformation finish temperature, etc. For practical reasons (such as the need to process several different wire diameters or to use different speeds) and for reasons of metallurgical reliability (normal compositional variations and segregration effects causing an increase in local austenite stability) total immersion times are conventionally much in excess of the time required for transformation (more often 15 to 20 seconds) to prevent bainite or martensite formation.

The surprisingly advantageous effect seen on wire plasticity and ultimate achievable strength in the stage of extreme strain hardening when treating a carbon steel wire produced in accordance with the present invention, is difficult to explain. A plausible hypothesis is that of an annealing-type effect of cementite lamellae in a manner analogous to spheroidizing treatment. However, in investigations it has not been possible to find any easily discernable microstructural differences between wires patented in accordance with the invention and conventionally treated wires. The fact that substantial differences become visible only after very large deformations points to a hitherto unknown submicroscopic phenomenon (which may be related to the fine surface structure of the cementite deformability at high strains in an unpredictable way, for example by retarding or provoking the onset of carbide necking and fragmentation).

In accordance with the preferred embodiment of the method of this invention, in which the patented steel wires are cooled to room temperature in a specified way by allowing said wires to stay a minimum time of about 3 seconds in the temperature interval from isothermal transformation down to about 400°–450° C., surplus carbon in the ferrite phase may be allowed to precipitate on the carbide lamellae and hence strain ageing sensitivity and ferrite plasticity are better-controlled in the final working stage of extreme drawing.

Figure 2:
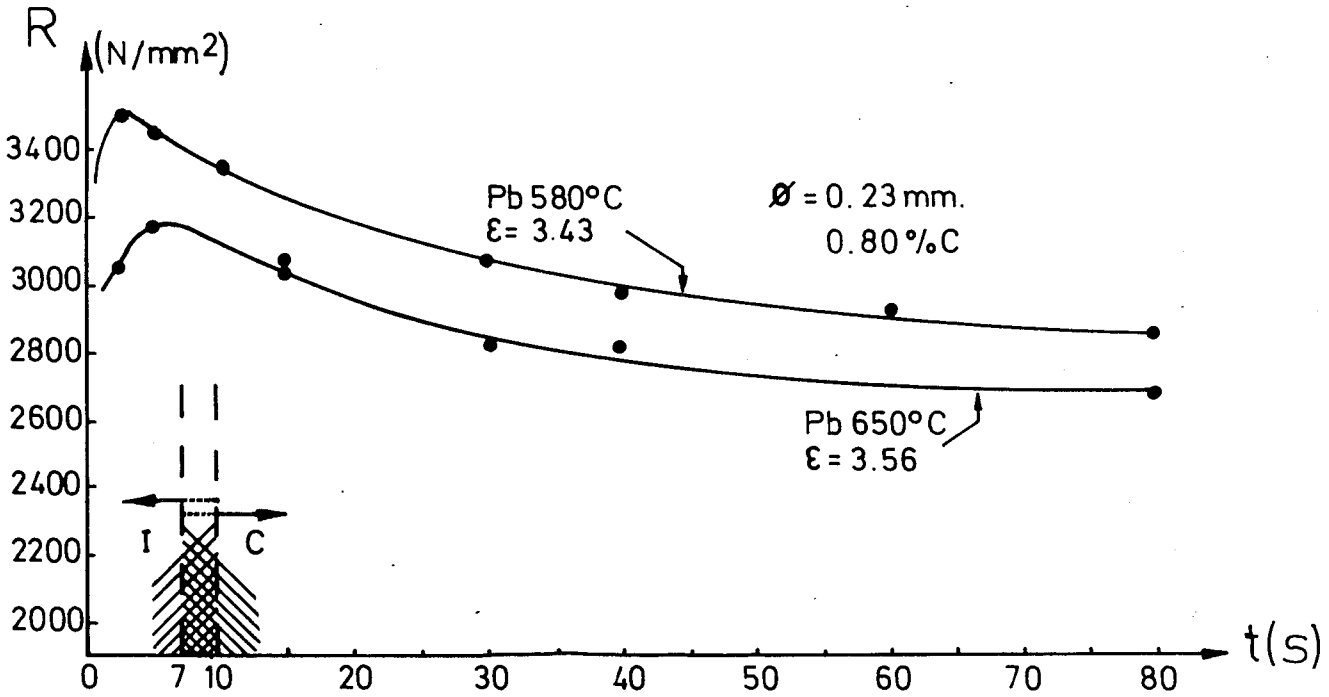
FIG. 2 is a graph showing how pearlite-soaking time affects ultimate wire strength R.

FIG. 2 shows a graph illustrating the influence of immersion time t in lead patenting (Pb-temp. 580° and 680° C.) on the ultimate strength R obtained after drawing a patented (unalloyed) 0.80% C steel wire to a fine diameter of 0.23 mm. The total true strain amounted to a value of 3.43 and 3.56. It can be seen that the greatest relative effect occurs at the left portion of the curve, typically when the retention time is restricted to below 5 seconds (corresponding to a total Pb-immersion time for the present eutectoid carbon steel of about max. 7–8 seconds at Pb=580° C., or 10–15 sec. at Pb=650° C.), preferably to about 1–3 seconds for best results. Below the optimum range of retention time strength values are again reduced because of the risk of incomplete transformation and bainite formation. On the graph symbol I indicates the preferred working range according to the invention and C the usual range. The precise location and width of transition range I/C will depend on the actual T.T.T.-diagram of the steel wire and on selected transformation temperature profile.

Figure 3:
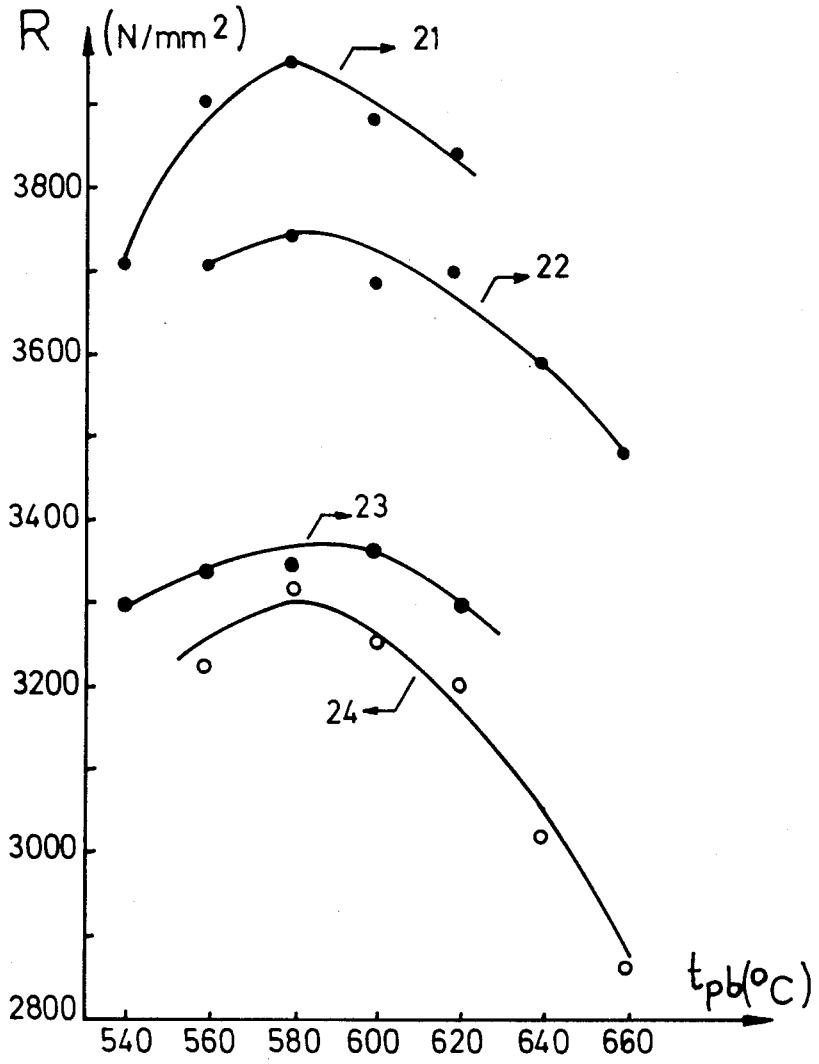
FIG. 3 is a graph which summarizes the strength gain of two carbon steel wires after patenting at different temperatures followed by drawing.

FIG. 3 shows the attainable gain in tensile strength R by the method of this invention for 0.85% C steel wire (upper curves 21 and 22) and 0.70% C (lower curves 23 and 24) as a function of isothermal transformation temperature $t_{Pb}$. Curves 21 and 23 refer to an optimum post-transformation retention time of about 2–3 seconds giving highest strength values. Curves 22 and 24 refer to intermediate retention times of about 5–7 seconds, showing already a marked decrease in attainable tensile strength. True drawing strains amounted to about 3.85–3.95.

Figure 4:
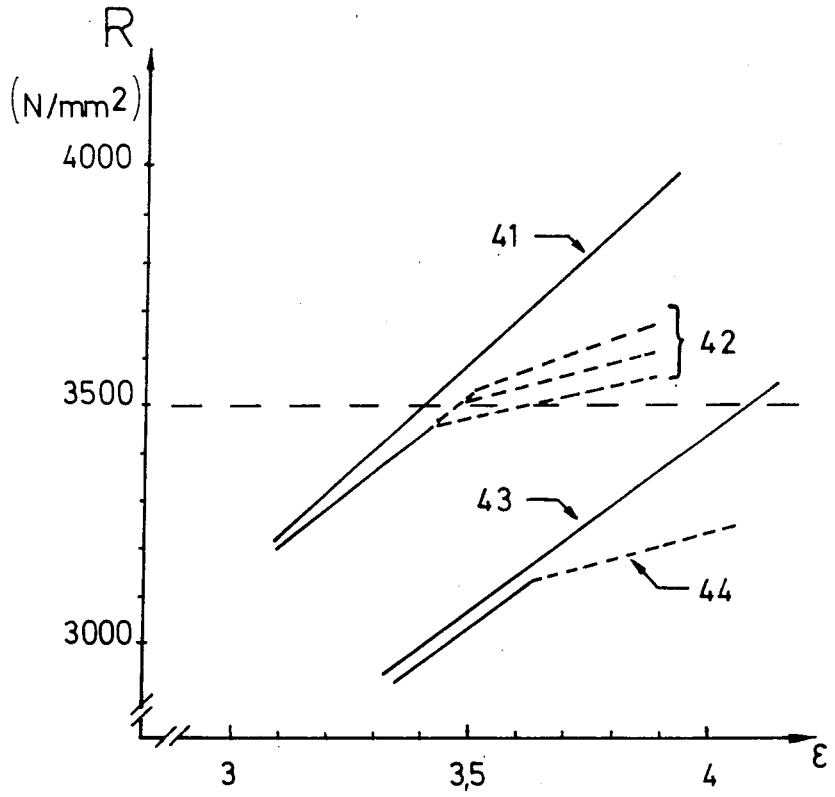
FIG. 4 is a graph which schematizes the difference in strain hardening and exteme drawability of high-strength wires of this invention in comparison to conventional wires.

FIG. 4 gives a schematic representation of the evolution of strain hardening of fine wires in the ultimate drawing state ($\epsilon > 3$ up to more than 4) for wires treated in accordance with the invention (straight lines 41 and 43) and for conventionally treated wires (dashed lines 42 and 44) for two carbon levels (0.85 and 0.70%). It shows that from a given $\epsilon$-value situated in the range 3 to 3.5 (and depending on the actual combination of carbon content and fineness of initial pearlite structure of patenting temperature) current wires start to deviate from the line of uniform hardening with increasing strain which may lead more or less rapidly to overdrawing (exhaustion of plasticity). Wires treated by the method of the invention show improved residual straining capacity at $\epsilon > 3.5$ and can be drawn to extemely high strength level (R above 3,200 N/mm$^2$ and even above 3,500 N/mm$^2$ according to carbon content and/or initial pearlite strength) without showing the undesirable phenomenon of brittle drawing breaks.

The examples given below relate to high-quality unalloyed carbon steels with 0.74 and 0.84% C. The steel composition is detailed in the following table.

TABLE 1

| | steel composition in percentage by weight | | | | | | | | |
|---|---|---|---|---|---|---|---|---|---|
| steel | C | Mn | Si | P | S | Cu | Cr | Ni | V + Mo + Nb |
| C-74 | 0.74 | 0.52 | 0.21 | 0.015 | 0.015 | 0.008 | 0.026 | 0.021 | 0.017 |
| C-84 | 0.84 | 0.51 | 0.23 | 0.012 | 0.010 | 0.012 | 0.031 | 0.022 | 0.021 |

Wire rods of steel C-74 and C-84 were processed to a desired semi-product diameter. At this stage the wires were subjected to a specified patenting treatment and electroplated with a brass coating of a rubber adherable composition (60–75% Cu and 40–25% Zn) and thereafter drawn to different end diameters.

EXAMPLE 1

Steel wire C-84 of 1.24 mm was treated at a patenting temperature of 580° C. and 620° C. with different total immersion times to vary the post-transformation retention time in a specified way. To evaluate the effect on work hardening and drawability at high strains, the wires were drawn to a total cross-sectional area reduction of at least 96%.

In table 2 the results are summarized for conventionally treated wires (total immersion time >10 seconds, post-transformation retention >5 seconds), process A, and for wires obtained according to the method of this invention (total immersion time 6–7 seconds; post-transformation retention >5 seconds, typically 1 to 3 seconds), process B.

TABLE 2

| | | Tensile strength (N/mm$^2$) of drawn wires | | | |
|---|---|---|---|---|---|
| | Total | process A | | process B | |
| Diameter mm | strain $\epsilon$ | T = 580° C. | T = 620° C. | T = 580° C. | T = 620° C. |
| 0.220 | 3.46 | 3433 | 3345 | 3345a | 3448 |
| 0.200 | 3.65 | 3540 | 3450 | 3680 | 3566 |
| 0.175 | 3.92 | 3715 | 3674 | 3950 | 3840 |

The results show that in similar careful drawing conditions the wires treated in accordance with the invention consistently achieved higher strength levels, this strength gain clearly increasing at extreme strains. This is indicative of the fact that treatment in accordance with the invention provides a microstructure which, after heavy deformations to an aligned and severely work-hardened cementite/ferrite structure, has an improved capacity to sustain additional uniform straining.

EXAMPLE 2

A steel wire of composition C-74 was lead patented and brass plated at a diameter of 1.35 mm. Two series of wires were run at the same speed on an installation comprising a gas fired austenitizing furnace (final wire temperature of 950° C.) and a lead bath at 560° C. The first series of wires was immersed over the entire bath length as known in the art and shortly thereafter cooled down to room temperature. Total immersion time was about 12 seconds, process C. For the second series of wires the immersing length was restricted to a holding time of maximum 6 seconds and the wires were allowed to cool in still air to 400°–450° C. in about 4 to 5 seconds before being subjected to a water quench to room temperature, process D. Wires of each series were drawn in 18 drafts to 0.25 mm and thereafter further drawn to still lower diameters in 5 extra drafts to determine ultimate cold workability and strain hardening. The results are summarized in table 3.

TABLE 3

Mechanical properties and drawability of wire C-74

| Diameter mm | Drawing strain $\epsilon$ | Process C T.S. N/mm$^2$ | Process C $N_t$ Torsions | Process D T.S. N/mm$^2$ | Process D $N_t$ Torsions |
|---|---|---|---|---|---|
| 0.25 | 3.37 | 2935 | 83 | 2970 | 96 |
| 0.23 | 3.54 | 3001 | 80 | 3086 | 85 |
| 0.205 | 3.77 | 3205 | 72 | 3340 | 81 |
| 0.185 | 3.98 | 3246 (+) | 50 (+) | 3486 | 73 |
| 0.17 | 4.14 | n.d. | — | 3605 | 48 (+) |
| 0.16 | — | — | — | n.d. | — |

n.d.: not drawable
(+): brittle fracture appearance

Up to a drawing strain of about 3.5 both wire types show comparable mechanical properties (0.23 mm diameter) with a slight advantage for the wires of this invention. At higher $\epsilon$-values the discrepancy in strain hardening becomes more clearly visible and the working limit of conventional wires is reached at about $\epsilon \approx 3.80$ beyond which true strain level additional work hardening is impeded and drawability becomes very poor. The wires treated by the method of the invention are still ductile and strain hardenable at strains in excess of $\epsilon = 3.8$ and make it possible to obtain a useful strength level of about 3400–3500 N/mm$^2$ with minor drawing breaks and adequate torsion ductility.

From the above examples it is possible to appreciate the particular merits of the improved steel wire patenting methods in accordance with the preferred embodiments of the invention, which are characterized by a specified post-transformation time-temperature profile, which provides a better plasticity and enhanced cold work hardening capability when drawing steel wires in their final stage of diameter reduction beyond an upper range of total true strain ($\epsilon = 3$ to 3.3 depending on steel composition and quality of initial structure), and more in particular above $\epsilon$-values of 3.4–3.6. As a consequence the working limit and useful tensile strength can be shifted to higher levels and industrial drawability can be ensured up to a critical diameter reduction stage which is either too risky or unattainable in conventional wire practice.

The improvement appears to be achieved irrespective of carbon content and patenting temperature (except that the relative effect is greatest in the transformation range 560°–620° C.). Hence, there is greater flexibility in choosing the most suitable combination of parameters (patenting temperature or patenting temperature profile, pearlite fineness, carbon content, total diameter reduction) to achieve either maximum strength or maximum drawability.

A particular feature of extremely deformed pearlitic steel wires treated in accordance with the present invention has been revealed by metallographic investigation of their cementite/ferrite substructure. We have found that the deformation capacity of axially stretched cementite lamellae in such wires is better than in conventional wires beyond a given drawing limit corresponding to the appearance of significant deviations in strain hardening behavior. At highest drawing reductions cementite deformation cannot follow the equivalent deformation of cold worked ferrite and the ratio of ferrite to cementite true strain increases up to 1.4–1.5 at which stage conventional wires already show overdraw brittleness with disintegration and accelerated breaking-up of cementite lamellae. The wires treated in accordance with the invention, however, are mostly still ductile at this level of microstructural strain differential and their more stale and necking-resistant cementite lamellae accommodate better the heavily work-hardened ferrite without being torn apart or being desintegrated in fine fragments.

Thus, at least in certain preferred embodiments there is provided a process which is economically attractive, universally applicable (regardless of steel composition and fineness/hardness of initial pearlitic structure) and yet surprisingly effective in fulfilling its objectives of shifting the drawing limit and attainable useful strength of pearlitic steel wire to substantially higher than usual values and of making the drawing process more reliable in the stage of extreme work-hardening.

I claim:

1. A process for producing a pearlitic steel wire, said process comprising the steps of subjecting the wire to a patenting operation in which it undergoes transformation in a transformation temperature range and of drawing the patented steel wire to a smaller diameter, characterized in that during the patenting operation the wire is held in the transformation temperature range during a retention time of no more than five seconds after transformation has been completed and in that the smaller diameter corresponds to a true strain of more than 3.

2. A process as claimed in claim 1 characterized in that the smaller diameter corresponds to a true strain of more than 3.5.

3. A process as claimed in claim 1 characterized in that the transformation temperature range in which the wire is held lies between 520° and 680° C.

4. A process as claimed in claim 1 characterized in that after the retention time the wire is cooled to a temperature in the range of 400° to 450° C. over a period of time which is not less than three seconds.

5. A process as claimed in claim 4 characterized in that the period of time for said first stage of cooling is not less than 5 seconds.

6. A process as claimed in claim 1, characterized in that the final diameter of the wire is up to 1.5 mm.

7. A process as claimed in claim 6, characterized in that the final diameter of the wire is in the range of 0.1 to 0.5 mm.

8. A process as claimed in claim 1 characterized in that the steel wire has a carbon content of from 0.4 to 1.2 percent by weight.

9. A process as claimed in claim 1 characterized in that the wire is drawn to a final tensile strength of more than 3,000 $Nmm^{-2}$.

10. A process as claimed in claim 1 characterized in that the wire is drawn to a final tensile strength of more than 3,200 $Nmm^{-2}$.

11. A process as claimed in claim 1 characterized in that the wire is drawn to a final tensile strength of more than 3,500 $Nmm^{-2}$.

12. A pearlitic steel wire characterized in that the wire has been produced in accordance with a process as claimed in claims 1 to 11.

13. A pearlitic steel wire for use in the reinforcement of rubber vehicle tires, the wire having a diameter in the range of 0.1 to 0.5 mm, a carbon content in the range of 0.7 to 1.0 percent by weight, and a rubber adherent brass coating, characterized in that the wire has been produced in accordance with a process as claimed in claim 1.

14. A process as claimed in claim 2 characterized in that the transformation temperature range in which the wire is held lies between 520° and 680° C.

15. A process as claimed in claim 2 characterized in that after the retention time the wire is cooled to a temperature in the range of 400° to 450° C. over a period of time which is not less than three seconds.

16. A process as claimed in claim 15 characterized in that the period of time for said first stage of cooling is not less than 5 seconds.

17. A process as claimed in claim 16 characterized in that the final diameter of the wire is up to 1.5 mm.

18. A process as claimed in claim 3 characterized in that after the retention time the wire is cooled to a temperature in the range of 400° to 450° C. over a period of time which is not less than three seconds.

19. A process as claimed in claim 18 characterized in that the period of time for said first stage of cooling is not less than 5 seconds.

20. A process as claimed in claim 19 characterized in that the final diameter of the wire is up to 1.5 mm.

21. A process as claimed in claim 1, characterized in that the final diameter of the wire is in the range of 0.1 to 0.5 mm.

22. A process as claimed in claim 2 characterized in that the steel wire has a carbon content of from 0.4 to 1.2 percent by weight.

23. A process as claimed in claim 2 characterized in that the wire is drawn to a final tensile strength of more than 3,000 $Nmm^{-2}$.

24. A process as claimed in claim 3 characterized in that the wire is drawn to a final tensile strength of more than 3,200 $Nmm^{-2}$.

25. A process as claimed in claim 4 characterized in that the wire is drawn to a final tensile strength of more than 3,500 $Nmm^{-2}$.

26. A pearlitic steel wire characterized in that the wire has been produced in accordance with a process as claimed in claim 3.

27. A pearlitic steel wire for use in the reinforcement of rubber vehicle tires, the wire having a diameter in the range of 0.1 to 0.5 mm, a carbon content in the range of 0.7 to 1.0 percent by weight, and a rubber adherent brass coating, characterized in that the wire has been produced in accordance with a process as claimed in claim 3.

28. A process as claimed in claim 3 characterized in that the steel wire has a carbon content of from 0.4 to 1.2 percent by weight.

29. A process as claimed in claim 3 characterized in that the wire is drawn to a final tensile strength of more than 3,000 $Nmm^{-2}$.

30. A process as claimed in claim 4 characterized in that the wire is drawn to a final tensile strength of more than 3,200 $Nmm^{-2}$.

31. A process as claimed in claim 5 characterized in that the wire is drawn to a final tensile strength of more than 3,500 $Nmm^{-2}$.

32. A pearlitic steel wire characterized in that the wire has been produced in accordance with a process as claimed in claim 4.

33. A pearlitic steel wire for use in the reinforcement of rubber vehicle tires, the wire having a diameter in the range of 0.1 to 0.5 mm, a carbon content in the range of 0.7 to 1.0 percent by weight, and a rubber adherent brass coating, characterized in that the wire has been produced in accordance with a process as claimed in claim 4.

34. A process as claimed in claim 4 characterized in that the steel wire has a carbon content of from 0.4 to 1.2 percent by weight.

35. A process as claimed in claim 4 characterized in that the wire is drawn to a final tensile strength of more than 3,000 $Nmm^{-2}$.

36. A process as claimed in claim 5 characterized in that the wire is drawn to a final tensile strength of more than 3,200 $Nmm^{-2}$.

37. A process as claimed in claim 6 characterized in that the wire is drawn to a final tensile strength of more than 3,500 $Nmm^{-2}$.

38. A pearlitic steel wire characterized in that the wire has been produced in accordance with a process as claimed in claim 5.

39. A pearlitic steel wire for use in the reinforcement of rubber vehicle tires, the wire having a diameter in the range of 0.1 to 0.5 mm, a carbon content in the range of 0.7 to 1.0 percent by weight, and a rubber adherent brass coating, characterized in that the wire has been produced in accordance with a process as claimed in claim 5.

* * * * *